United States Patent [19]

Garman et al.

[11] Patent Number: 4,688,760

[45] Date of Patent: Aug. 25, 1987

[54] LIFTING APPARATUS

[75] Inventors: David E. T. Garman, Llandridod Wells; Richard M. Rimington, Presteigne, both of Wales

[73] Assignee: Mangar Aids Limited, Presteigne, Wales

[21] Appl. No.: 794,502

[22] Filed: Nov. 1, 1985

[30] Foreign Application Priority Data

Nov. 6, 1984 [GB] United Kingdom ..... 8428009
Feb. 6, 1985 [GB] United Kingdom ..... 8502950
Oct. 9, 1985 [GB] United Kingdom ..... 8524851

[51] Int. Cl.[4] ..... B66F 3/24
[52] U.S. Cl. ..... 254/93 HP; 254/122
[58] Field of Search ..... 254/122, 9 C, 93 HP; 4/564, 565, 566; 187/18, 8.72; 182/63, 69, 14, 16, 141, 157

[56] References Cited

U.S. PATENT DOCUMENTS 2,725,578 12/1955 Keller ..... 254/93 HP
2,747,692 5/1956 Holmes ..... 254/122
3,412,873 11/1968 Barker ..... 187/18
3,695,582 10/1972 Clay ..... 254/93 HP

*Primary Examiner*—Robert C. Watson
*Attorney, Agent, or Firm*—Becker & Becker, Inc.

[57] ABSTRACT

Lifting apparatus including a base, a platform disposed above the base, a thrust device therebetween to lift the platform relative to the base, and a platform stabilizer enclosed within the thrust device to connect the platform and base in parallel. The platform stabilizer includes an upper extensible linkage device having upper end portions connected to the platform, a lower extensible linkage device having lower end portions connected to the base, and connecting arrangement connecting lower end portions of the upper extensible linkage device to upper end portions of the lower extensible linkage device so that the linkage devices are constrained to move in unison.

11 Claims, 7 Drawing Figures

LIFTING APPARATUS

BACKGROUND OF THE INVENTION

1. Field of the Invention

The present invention concerns a lifting apparatus of a type which comprises a base, a platform disposed above the base, thrust means therebetween to lift the platform relative to the base, and platform stabilizing means enclosed within the thrust means to connect the platform and base in parallel. The platform stabilizing means comprises an upper extensible linkage device having upper end portions which are connected to the platform, a lower extensible linkage device having lower end portions which are connected to the base, and connecting means which connect lower end portions of the upper extensible linkage device to upper end portions of the lower extensible linkage device, so that the linkage devices are constrained to move in unison.

2. Description of the Prior Art

Apparatus of the aforementioned type is known from U.S. Pat. No. 2,725,578 Keller dated Dec. 5, 1955. However, in this known apparatus, several of the linkage devices form parts of a vertically and horizontally extending bracing means, incorporating three separate lazytongs arranged at the sides of an equilateral triangle to provide vertical bracing in three mutually inclined vertical planes. Each of the lazy-tongs is slidably connected to the base and to the platform, and includes upper and lower linkage devices, as well as an intermediate linkage device which serves as a connecting means to connect the upper and lower linkage devices. A central pivot of each of the three upper linkage devices is connected to an upper peripheral circular ring member, and central pivots of the three intermediate and three lower linkages are similarly connected respectively to an intermediate ring member and a lower ring member. The three ring members are arranged horizontally to form part of the bracing means, and are secured to the inside of a pleated bellows which serves as the thrust means. In this known apparatus, the three surrounding ring members and the three separate lazytongs necessary for platform stabilization give rise to various problems, e.g. an extremely high manufacturing cost, complexity, and, most importantly, poor stabilization of the platform due to uneven or unequal movement (extension or contraction) of the lazy-tongs which allows the platform (and/or ring members) to tilt relative to the horizontal. Furthermore, the bearing or pivot clearances, which are necessary for relative pivotal movement of the parts of the lazy-tongs relative to each other and relative to the ring members, allow the platform to move linearly in any direction in or near to the plane of the platform. In any lifting position of the platform intermediate its maximum upper and minimum lower positions, the bracing means allows the platform to rotate freely through a restricted but unacceptably large angle, thus failing to stabilize the platform and allowing twisting torsion loads to be applied to the relatively weak bellows. Thus, the platform can pitch, roll and yaw to an unacceptable extent.

A further drawback of this known apparatus is that the ring members have to be directly attached to the bellows and subject the lazy-tongs to lifting forces which are produced by the bellows; thereby giving rise to the further problems of wear, friction and malfunction of the platform stabilizing means.

However, this known apparatus has the advantage that the horizontal dimensions of the linkage devices are relatively small in relation to the overall lift distance which can be produced by the apparatus, so that the apparatus is compact when the platform is lowered.

An object of the present invention is to enable the problems encountered with heretofore known lifting apparatus to be reduced or avoided.

SUMMARY OF THE INVENTION

The present invention is characterized primarily in that the upper and lower extensible linkage devices each comprise a single inner rigid member, which is pivotally secured between two outer rigid members by median pivot means, so that the outer rigid members are held in spaced apart relationship for constrained arcuate movement about a common median axis. Also, the linkage devices are connected, so that said median axes are parallel.

A lifting apparatus according to the present invention is further characterized in that a first two of said upper end portions of the upper extensible linkage device are secured to the platform by upper pivot means, so as to be constrained to pivotal movement about an upper common axis fixed in relation to the platform, in order that a second two of the upper end portions of the upper extensible linkage device are movable linearly of the platform and perpendicular to said upper common fixed axis. A first two of said lower end portions of the lower extensible linkage device are secured to the base by lower pivot means, so as to be constrained for pivotal movement about a lower common axis which is fixed relative to the base and is disposed vertically below, and parallel with, the upper common axis, in order that a second two of said lower end portions of the lower extensible linkage device are movable linearly relative to the base and perpendicular to the lower common axis.

In particular, the present invention provides an apparatus of the aforementioned type wherein linkage devices comprise rigid members, which are pivotally connected, so as to be arcuately movable about axes which are maintained mutually in parallel by said rigid members. An upper one of these axes is fixed in relation to the platform and a lower one of these axes is fixed in relation to the base so that the platform is constrained against arcuate movement, relative to the base, in all positions of the platform.

The thrust means is preferably pneumatically inflatable to apply lifting forces directly to the platform independently of the platform stabilizing means.

The present invention also provides apparatus of the aforementioned type wherein each linkage device comprises a rigid member pivotally secured between two outer rigid members by means of a median pivot, so that the outer rigid members are held in spaced apart relationship for constrained arcuate movement about a common median axis. In addition, the connecting means comprise a plurality of intermediate axes, each of which passes through end portions of the inner rigid member of one of the linkage devices and the outer rigid members of the linkage devices, in order to confine these outer rigid members to arcuate movement relative to the inner rigid member. The upper linkage device is pivotally connected to the platform about an upper common axis fixed in relation to the platform, and the lower linkage device is pivotally connected to the base about a lower common axis fixed in relation to the base and, parallel with and vertically below, the upper common axis. The inner rigid members thereby locate the median and the intermediate axes parallel with the common axes.

The present invention further provides a lifting apparatus of the aforementioned type wherein:

(a) the upper and lower extensible linkage devices each comprise an inner rigid member, which provides two of said upper end portions and two of said lower end portions in rigid spaced apart relationship; and the inner rigid member is pivotally secured between two outer rigid members by median pivot means, so that the outer rigid members are held in spaced apart relationship for constrained arcuate movement about a common median axis; and (b) a first two of said upper end portions of the upper extensible linkage device are secured to a platform by upper pivot means, so as to be constrained to pivotal movement about an upper common axis fixed in relation to the platform in order that a second two of the upper end portions of the upper extensible linkage device are movable linearly of the platform and perpendicular to said upper common fixed axis; and a first two of said lower end portions of the lower extensible linkage devices are secured to the base by lower pivot means, so as to be constrained for pivotal movement about a lower common axis, which is fixed relative to the base and is disposed vertically below and parallel with the upper common axis, in order that a second two of said lower end portions of the lower extensible linkage device are movable in unison linearly relative to the base and perpendicular to the lower common axis.

The apparatus of the present invention thus provides complete stability for the platform by the use of stabilizing means that is smooth (i.e. non-jerky) in operation, compact in relation to the lift which can be produced, and of relatively light and simple construction.

The inner rigid members preferably provide stop means which is abutted by the outer rigid members when the apparatus is in the lowered (i.e. minimum height) position. The outer rigid members of each linkage device are preferably connected, by tie means, to further secure the outer rigid members in a parallel relationship.

The inventive apparatus is particularly suitable for low pressure pneumatic operation, e.g. those operations using a pneumatic supply of less than 1 kilogram per square centimeter, and preferably less than 0.5 kilograms per square centimeter (0.5 kg/cm$^2$).

Since the platform stabilizing means is of a particularly rigid construction in relation to movement about the axes, and is substantially relieved of all lifting loads, the extended angle between the inner and outer rigid members may be very large at a maximum lift. The inventive lifting apparatus is preferably arranged so that this angle can be at least 130°, and preferably at least 135°, or more, so that the maximum distance between the platform and base can be about 80% of the combined overall length (height) of the inner rigid members, without loss of platform stability.

The connecting means preferably comprises intermediate pivot means which directly pivotally connect the upper and lower linkage devices.

The platform stabilizing means is particularly effective, is simple and inexpensive to construct, and is reliable in use.

The platform and base preferably each have a pair of parallel guides secured rigidly thereto, so as to be offset outwardly from the linkage devices and to slidably receive sliders supporting pairs of coaxial main pivots which project outwardly from the linkage devices.

The inner rigid members each preferably integrally incorporate two parallel main elongate portions, from which the upper and lower end portions project, and a plurality of rigid transverse portions extending between and supporting the main elongate portions Each of the intermediate and the median pivot means preferably comprises a rigid rod, which extends transversely across the platform stabilizing means and through axially elongate cylindrical bearings of the inner and outer rigid members.

The lower pivot means preferably comprise a lower rigid rod, and the upper pivots may comprise an upper rigid rod, which rods extend across the platform stabilizing means and are secured in end portions of the guides. Each main pivot means preferably comprises a rigid rod which extends across the platform stabilizing means and is secured in the sliders.

The inventive apparatus may be provided with a part, such as a seat, seat and backrest assembly, cushion, cradle, flank panel or mattress mounted, e.g. releasably located, upon the platform, while the platform may be shaped to receive such a part.

The present invention provides a backrest assembly in a particularly easy to fit and remove form. The backrest assembly comprises a frame, a facing supported on the frame, oppositely directed lugs which are located on the frame and which fit into first recesses provided by the platform, and manually retractable bolts which are biased to outwardly projecting positions for engaging second recesses which are located on the platform.

The side edges of the platform, and optionally also the front and rear edges of the platform, may be provided with protuberances which extend longitudinally of the edges to receive slide-on fittings for adjustably locating arm-rest, leg-support panels, or flank panels on the platform.

The present invention further provides a flank panel assembly for use with a form of the inventive apparatus having, along the side edges of the platform, an elongate headed protuberance joined to the platform by a neck, with the assembly comprising a panel and a hinge. The hinge comprises a first relatively rigid part having an elongate recess shaped to accept the protuberance, a second relatively rigid part secured to the panel, and a thin flexible elongate intermediate part. This hinge is a co-extrusion of rigid and flexible plastics materials.

The base may be provided with feet, suction cups, castors, or wheels or may form part of a bath, chair, bed, floor, wheelchair, trolley, or vehicle.

Biasing means and/or motion damping means may be enclosed in the thrust means to act on the platform stabilizing means. Lift limiting means may also be provided to limit the maximum distance between the base and the platform.

The pneumatic thrust means include a flexible wall, and in experiments with various forms of the apparatus, it has been found that distortions of the flexible wall can arise under certain conditions. However, advantageous wall constructions will overcome this problem. According to one example of an advantageous wall construction, the flexible wall is preferably provided with vertically spaced horizontal stiffeners which are bonded to inwardly projecting flexible portions of the wall within the extensible member. These stiffeners may be of flattened or tapered section, and are preferably cast or injection molded.

BRIEF DESCRIPTION OF THE DRAWINGS

The advantages of the present invention will appear more clearly from the following specification in conjunction with the accompanying drawings, in which.

DESCRIPTION OF THE PREFERRED EMBODIMENT

Figure 1:
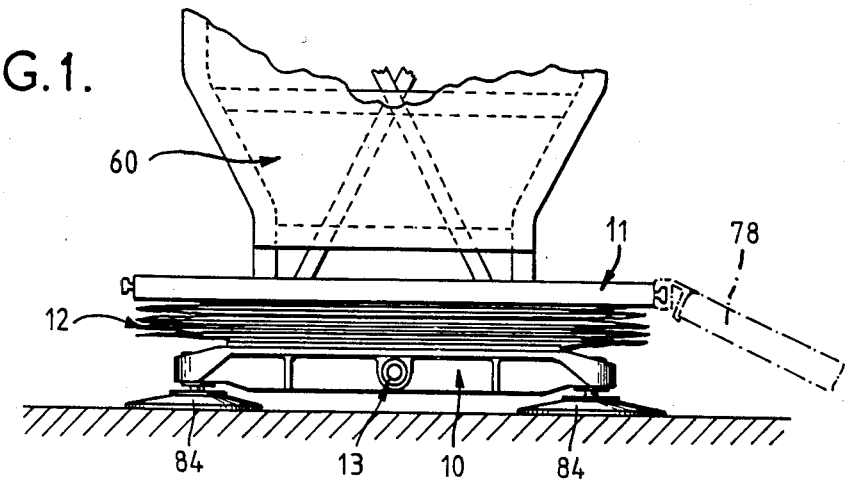
FIG. 1 is a front elevational view of one embodiment of a lifting apparatus according to the present invention, with the lifting apparatus being in a lowered position.

Referring now to the drawings in detail, lifting apparatus shown therein comprises a base 10 and a platform 11, together with low pressure pneumatic thrust means 12, means 13 to admit pressurized fluid into the thrust means 12, and platform stabilizing means 14, which is located between the base 10 and platform 11 and is surrounded by the thrust means.

The thrust means 12 has a flexible wall 15, of a large area concertina bellows form, which extends between and is sealed to the base 10 and platform 11 (e.g. as hereinafter described). The means 13 is provided, for example, in the form of a valve and fluid plug socket, in the base 10 or in the platform 11 or in the wall 15.

The platform stabilizing means 14 generally comprises an upper extensible linkage device 20, a lower extensible linkage device 21, and connector means 18, which may include an extensible linkage device, for example, as hereinafter described.

Each extensible linkage device 20, 21 is an assembly comprising two elongate outer rigid members 16, which are connected by median pivot means 17 to opposite sides of an inner rigid member 19 so as to be relatively angularly movable. Thus, when the linkage device increases in height and decreases in width, an angle A (which formed between the inner member 19 and the outer members 16) is increased, and vice versa.

Figure 3:
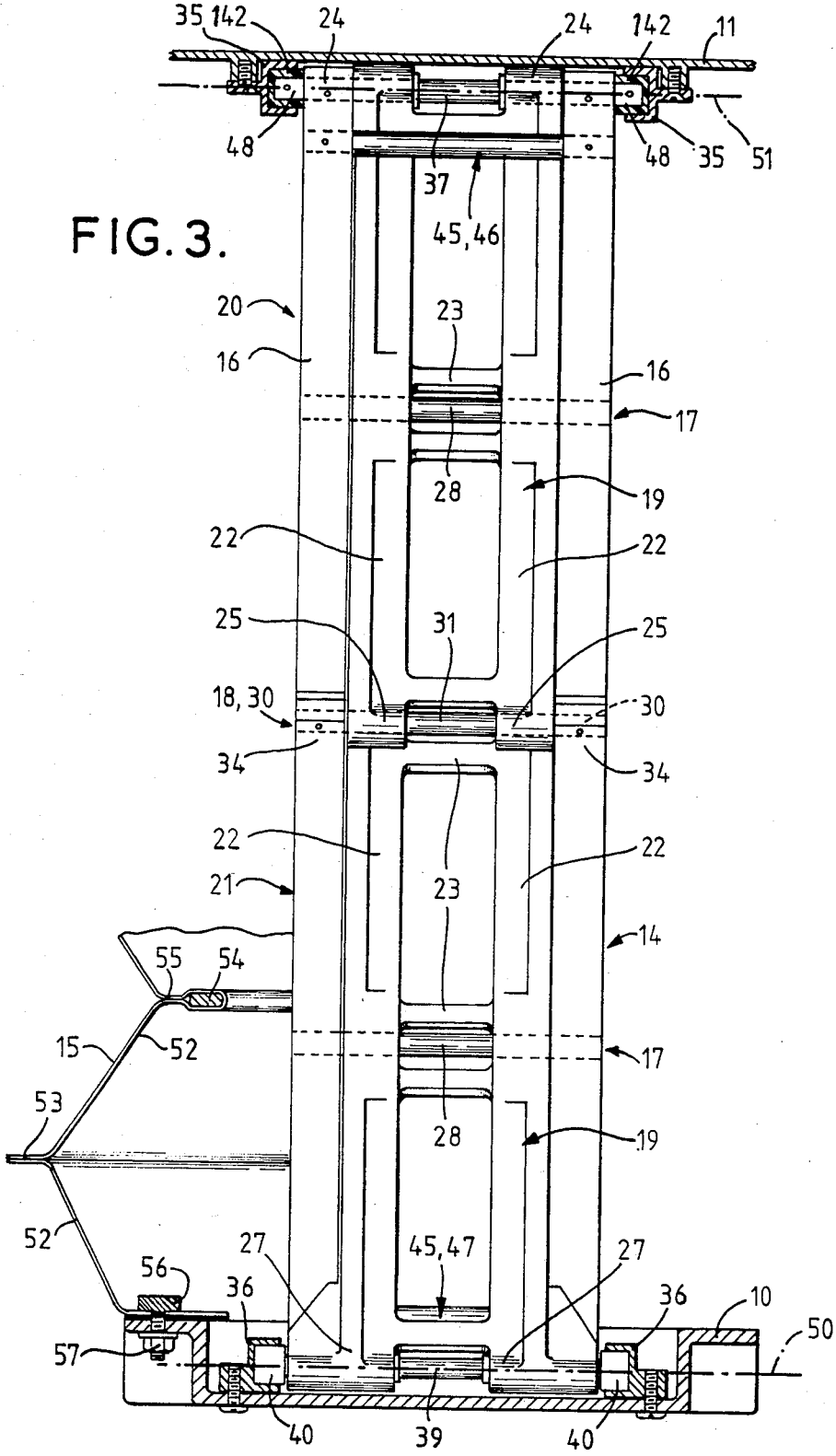
FIG. 3 is a partly-sectioned front elevational view of a platform stabilizing means of the inventive lifting apparatus.
Figure 4:
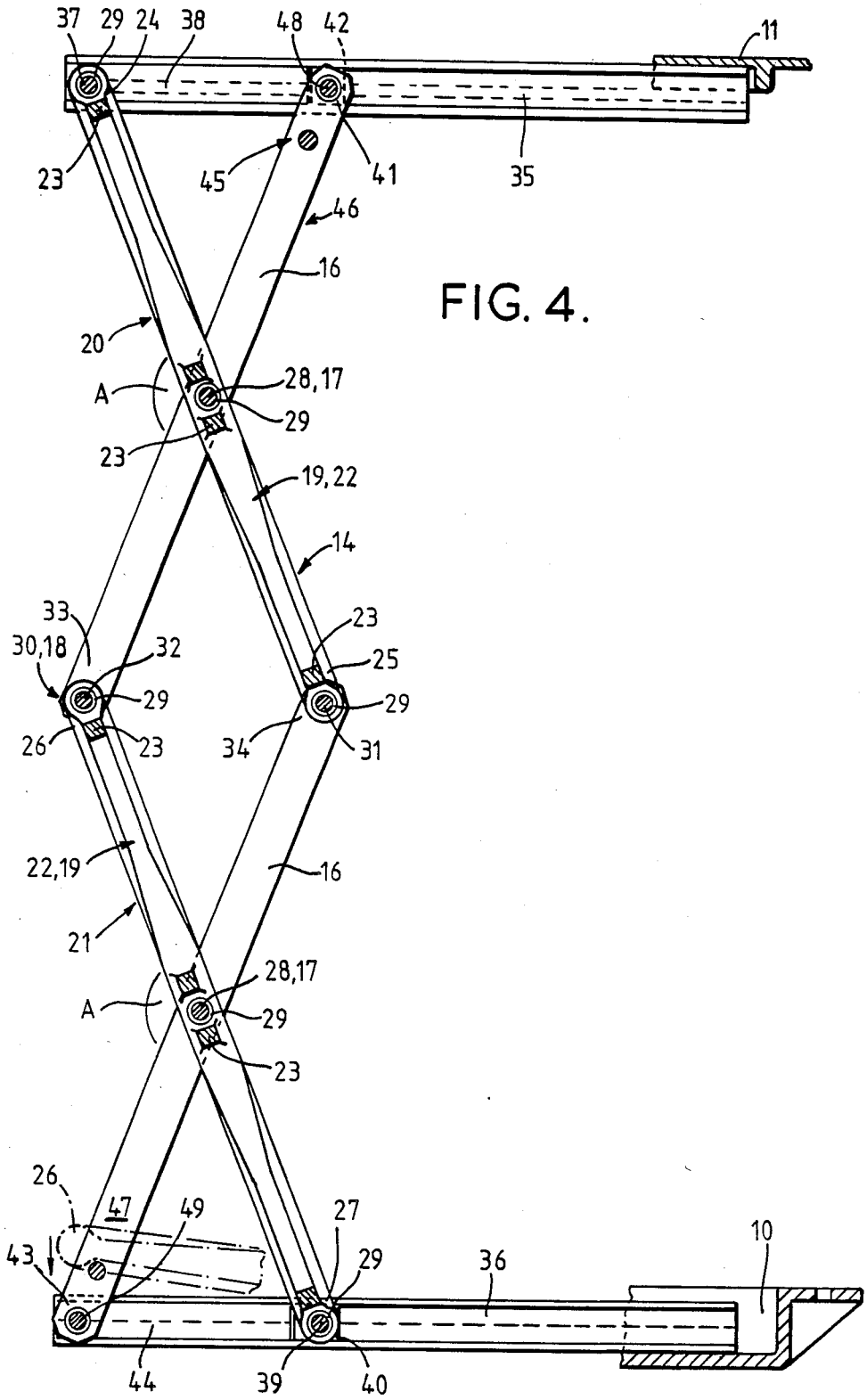
FIG 4 is a vertical cross-sectional view of this platform stablilizing means.
Figure 5:
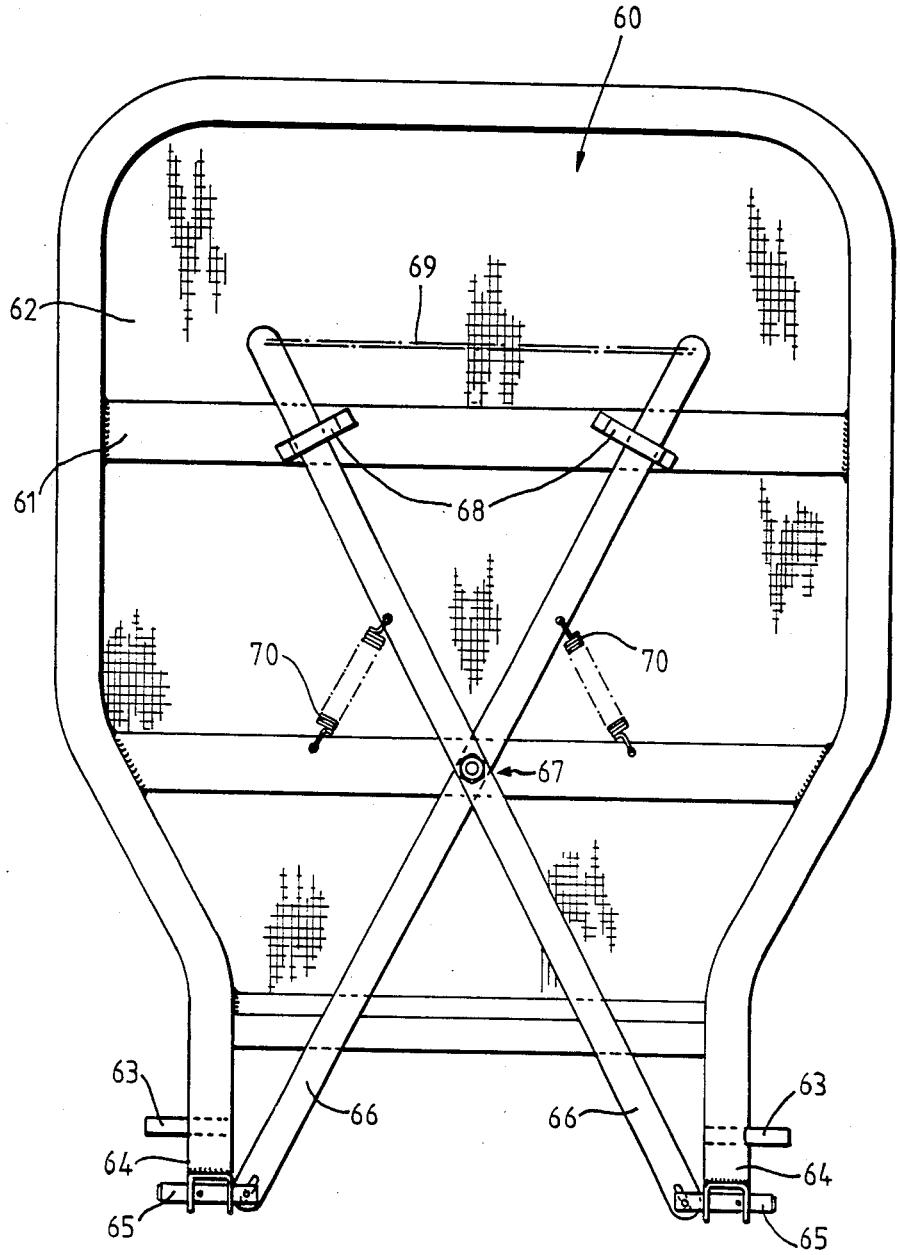
FIG. 5 is a rear elevational view of a backrest assembly of or for the inventive lifting apparatus.

The rigid members 16 and 19 are of a strong metal or alloy, e.g. aluminum alloy, and are cast or machined so that, in transverse cross-section, the members 16 and the main portions 22 of the members 19 are substantially as wide as they are thick. The main portions 22 of each member 19 are secured in rigid parallel relationship by rigid integral transverse portions 23, which are disposed adjacent the median pivot means 17 and between projecting end portions 24 and 25 or 26 and 27 of the main portions 22, as shown in FIGS. 3 and 4. One or more of the extreme transverse portions 23 may be hollow and extend to the ends of the rigid member 19 to close the gap between the end portions 24 and 24; 25,25; 26,26; and/or 27 and 27, and to further integrally unite said end portions.

The median pivot means 17 each comprise a rigid metal rod 28, which extends through axially elongate bearing sockets 29 (FIG. 4) and transversely horizontally across the linkage device 20 or 21.

The connector means 18 comprises parallel intermediate pivot means 30, each of which comprises a metal rod 31 or 32, which extends across the linkage devices and through the bearing sockets 29. The rod 32 connects the upper end portions 26 of the member 19 of the linkage device 21 to the lower end portions 33 of the members 16 of the upper linkage device 20. Similarly, the rod 31 connects the lower end portions 25 to the upper end portions 34 of the members 16 of the lower linkage device 21.

The platform and base have, releasably secured thereto, respective pairs of mutually opposed upper guides 35 or lower guides 36. These guides are of channel form, are arranged in parallel, and are offset outwardly from the linkage devices 20, 21. The upper end portions 24 support a further metal rod 37 in bearing sockets 29. This rod is provided with outwardly projecting end portions (not shown), each of which is secured fixedly to an end part of an upper guide 35, and is bedded in a plastics block 38 which is fixed in the guide 35. The lower end portions 27 similarly support a further metal rod 39. This rod 39 is provided with outwardly projecting end portions (not shown), which are bedded in plastics-block sliders 40 that maintain a tight sliding fit within the lower guide 36. The end portions 24 and 27 extend outwardly adjacent to the guides 35, 36 in order to further support the rods 37, 39.

The rods 28, 31, 32, 37, and 39 provide bracing for the end portions and are a close, or push, fit in the bearing sockets 29.

The upper end portions 41 of the members 16 of the upper linkage device 20 may support a rod, which is similar to the rod 39, having end portions embedded in plastics block sliders 42 in the upper guides 35. The lower end portions 43 of the members 16 of the lower linkage device 21 may support a rod, which is similar to the rod 37, having end portions embedded in plastics blocks 44 which are fixed in the lower guides 36. However, in the embodiment shown, the linkage devices 20, 21 are provided with tie means 45, which comprises a rigid upper bar 46 that extends horizontally between, and is secured to, the upper end portions 41 and a similar lower bar 47 which is secured to the lower end portion 43. This tie means 45 is proximal to the end portions 25 and 26 when the apparatus is in the lowered position shown in FIG. 1. The tie means 45 provides rigid spacing and bracing for the end portions 41 and 43, so that a weight saving can be made by mounting respective individual short rods 48, 49 in the end portions 41 and 43 to engage in the sliders 42 and blocks 44.

As an alternative to the use of plastics block sliders 40 and 42, the outwardly projecting end portions may be slidable in low-friction plastics channel section inserts within the guides, e.g. as indicated at 142 in FIG. 3.

While in use, the rods 37 and 49, respectively, serve as upper pivot means and lower pivot means, and provide an upper horizontal common fixed axis and a lower horizontal common fixed axis which is vertically below, and parallel with, the upper common fixed axis, so that the end portions 24 and 43 are restricted solely to pivoted movement relative to the platform 11 and base 10. The rods 39 and 48, respectively, serve as lower main pivot means and upper main pivot means, and provide lower and upper horizontal common main axes 50, 51 (FIG. 3) for pivotal movement of the end portions 27 and 41 relative to the sliders 40, 42. The axes 50 and 51 are solely horizontally movable in unison in relation to the guides 36, 35, so that the upper main axis 51 remains vertically above, and parallel with, the lower main axis 50.

In the fully raised maximum lift position (FIGS. 3 and 4) the sliders 40, 42 abut the blocks 44, 38 (which thus serve as stop means to prevent further lift which would increase the angle A beyond a maximum of 140°). The sliders move forwards (away from the blocks) as the platform 11 is lowered, and causes the linkage devices 20, 21 to retract downwards and to extend forwards, thereby decreasing the angle A, until further movement is halted by the end portions 34 and 33 which abut the end portions 27 and 24. These end portions 27 and 24 are outwardly extended to serve as stop means in the lowered position, so that the guides and pivots are not subjected to any major stresses.

During movement of the platform, the relatively large axial length to diameter ratio (e.g. at least 2:1) of the bearing sockets, in combination with the close or tight fit of the rods in the bearing sockets, blocks and sliders, prevent any significant unwanted movements of said axes from their precisely parallel relationships. This also serves to minimize wear. Furthermore, only the linearly sliding surfaces of the sliders are subjected to any slow but significant wear during repeated operation. In addition, these sliders can be replaced cheaply and easily after simply removing the guides, which thus serve as releasable connecting means that connect the stabilizing means 14 to the base and to the platform 11.

Figure 2:
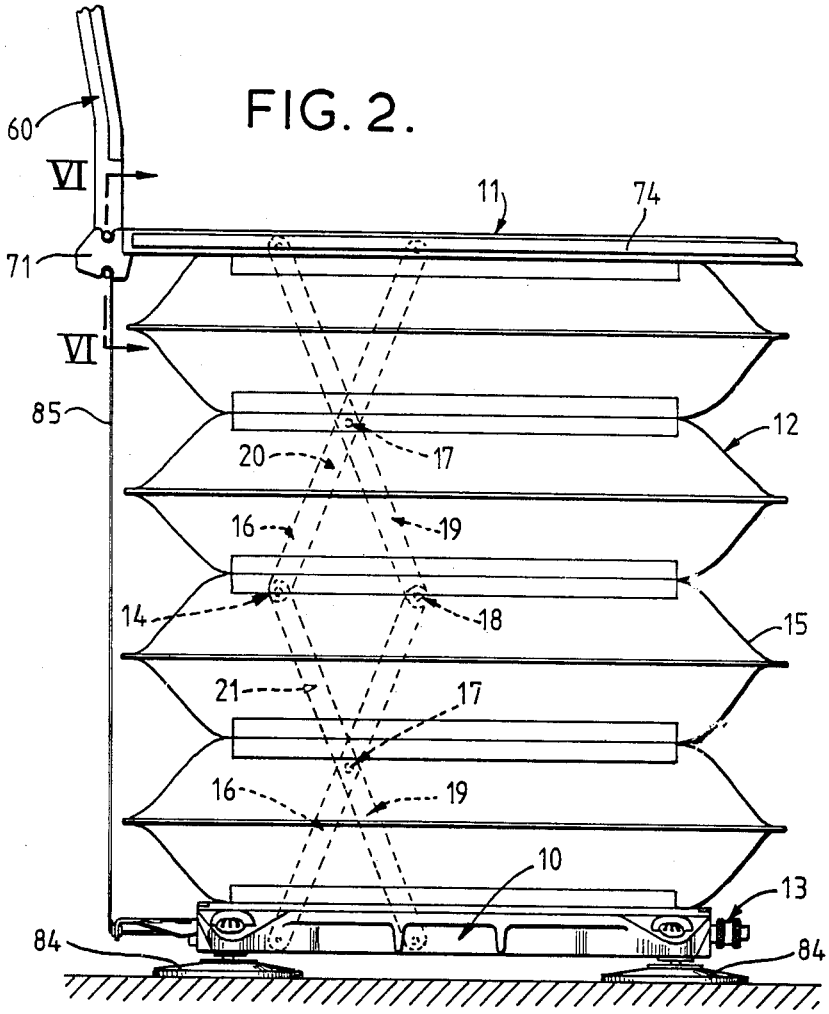
FIG. 2 is a side elevational view of one embodiment of a lifting apparatus according to the present invention, with the lifting apparatus being in a fully raised position.

Referring in general to FIGS. 2 and 3, the flexible wall 15 is of segmental construction and, as indicated in FIG. 3, comprises strips 52 of impervious, and flexible but substantially inelastic, material which is bonded together at outer junctions 53, and is bonded together and to stiffeners 54 at inner junctions 55. The stiffeners 54 are of flattened cross-section, have rounded or tapered edges, and are substantially rectangular in plan. The lowermost and uppermost strips 52 are respectively clamped to the base 10, e.g. by a clamping ring 56 and fasteners 57, and similarly to the platform 11, in order to effect a seal therewith which renders the thrust means 12 airtight except for the means 13. This allows the platform to be raised or lowered by inflation or deflation of the thrust means. Since the large area bellows allows a large load to be lifted by a direct thrust on the platform, the stabilizing means is not subjected to any lifting loads. For example, a load of about 100 kg can be lifted on a platform of about 0.15 $m^2$ in area through a distance of 40 cm by a pneumatic supply pressure of only about 0.35 $kg/cm^2$.

Referring to FIGS. 1, 2, 5 and 6, the lifting apparatus may be arranged to support and lift a person. In this embodiment, the inventive apparatus comprises a backrest assembly 60, which, in turn, comprises a frame 61, a molded plastics facing 62, oppositely directed lugs 63 which are located on lower portions 64 of the frame, bolts 65 which are slidably mounted on the lower portions 64, crossed levers 66 which are connected to the bolts and are pivotally mounted by means of a central pivot 67 and guides 68 on the frame, and a cross-rope 69 which connects the upper ends of the levers 66. The rope 69, when pulled upwards, causes the bolts 65 to be retracted inwards, against a bias provided by springs 70.

The rear of the platform 11 is shaped to provide a pair of mountings 71, each of which provides an upwardly open socket 72 for one of the lugs 63, and a parallel downwardly open socket 73 which accepts one of the bolts 65 and thereby secures the backrest assembly for the platform. When the bolts are retracted, as indicated in broken lines in FIG. 6, the backrest assembly 60 can be simply lifted off the platform.

Figure 6:
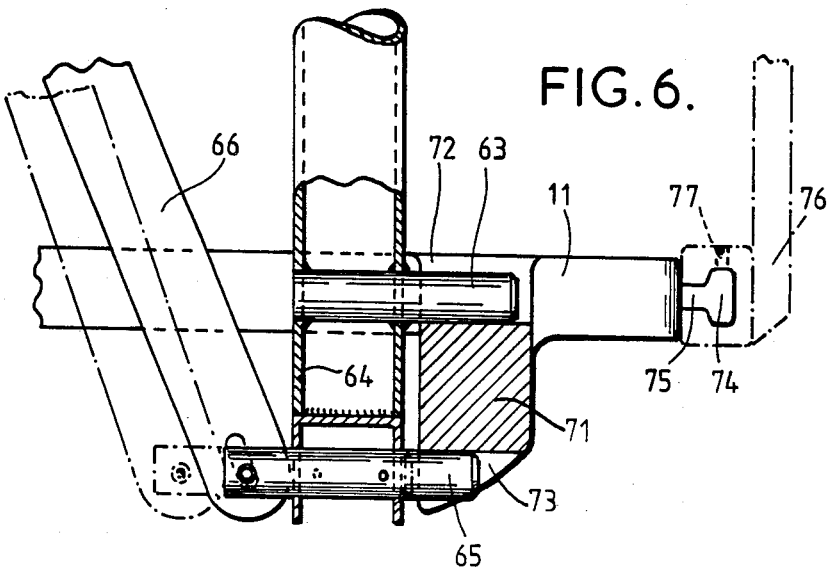
FIG. 6 is a partly sectioned detailed view of parts of the backrest and lifting apparatus.
Figure 7:
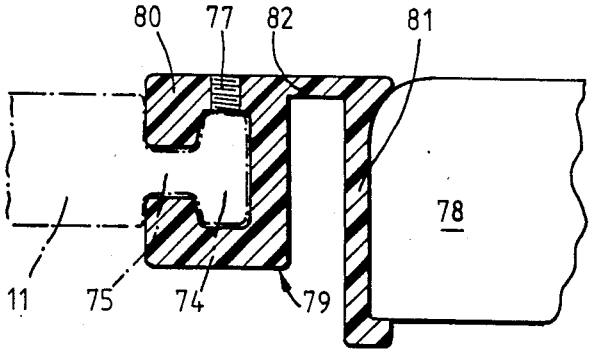
FIG. 7 shows part of a platform, hinge and flank panel of the inventive apparatus in transverse cross section.

The platform 11 also has, along each side, an elongate and headed protuberance 74 which is joined to the platform by a neck 75. The protuberances 74 serve as mountings for slide-on supports 76 (for armrests or similar fittings) having clamping screws 77 that secure the supports 76 in fixed positions on the platform as shown in FIG. 6, or as mountings for flank panels 78 shown in FIG. 7 and indicated in broken lines in FIG. 1.

The flank panels 78 operate, and are used, as described in British Patent Specification No. 2110527. The flank panels 78 are secured to the mountings 74,75 by a plastics hinge 79 which comprises a first elongate portion 80 that is shaped to fit onto the mounting, a second portion 81 that is secured to the panel 78, and a thin flexible portion 82 that connects the portions 80 and 81. The hinge is a unitary/coextrusion of relatively rigid plastics material, which forms the portions 80, 81, and a relatively flexible plastics material, which forms the portion 82.

The base 10 is provided with four swivel mounted suction feet 84, and a lift limiting cord 85 that actuates the means 13 and thereby limits inflation of the thrust means. The cord 85 may be adjustably secured to the platform, backrest, or armrest.

The present invention is not confined to details of the foregoing examples, and many variations are possible within the scope of the invention. For example, the longitudinal orientation of the devices 20 and 21, as shown in FIG. 4, may be reversed so that the upper pivots locate the upper end portions 41. The connecting means may also comprise an intermediate extensible linkage device and two additional rods similar to the rods 32, 31.

Clearly, the, or any of the rods, which extend across the linkage devices, may be replaced by pairs of co-axially aligned pairs of short rods, e.g. similar to the rods 48 and 49, which act to connect together the rigid members or to connect the rigid members to the blocks or sliders, and permit arcuate movement about said axes, thereby providing the, or any one of the, several pivot means.

The rigid members, guides, mountings, and pivots may be of any suitable construction and configuration. The rigid members may also be cast so as to have rounded edges.

The stabilizing means may incorporate stops, dampers, shock absorbers, or bias means, in order to limit, smooth, or bias the movement of the rollers or sliders relative to the guides.

The flexible wall may be of any suitable form and of any suitable construction; and may be secured to the platform and base in any suitable manner. The corners of the wall may also be rounded to facilitate sealing.

Connectors may be includes to enable several units of the apparatus to be arranged in a stack or row and to be connected so as to operate sequentially or in unison. The connectors may also incorporate self sealing fluid couplings.

The inventive apparatus is particularly suitable for operation in connection with a low pressure compressed air supply; and preferably includes a manually operable valve means, in order to control admission and release of air into and out from the thrust means, along with a pressure relief valve which acts to limit the maximum working air pressure within the thrust means.

The inventive apparatus may also include manually releasable safety means which hold the platform at a selected or predetermined height.

The inventive apparatus is capable of being used in a wide variety of applications, may carry a variety of fittings, and may be mounted on a variety of supports. The base and platform may be shaped to suit the supports and fittings, and may include a removable or openable inspection or maintenance hatch or panel which provides access to the linkages and other components within the thrust means. The apparatus may also be operated in any required orientation, e.g. may be inclined to the vertical or may be horizontal (the terms "vertical", "horizontal", and "front" being used herein in relation to the apparatus when it is orientated as shown in the drawings).

The present invention is, of course, in no way restricted to the specific disclosure of the specification and drawings, but also encompasses any modifications within the scope of the appended claims.

What we claim is:

1. A lifting apparatus which comprises:

a base provided with a first side;

a platform provided with a first side and a second side;

thrust means positioned between said first side of said base and said first side of said platform to lift said platform relative to said base;

platform stabilizing means enclosed within said thrust means and maintaining said base and said platform in parallel relation to one another, said stabilizing means being provided with a first extensible linkage means having first end portions and second end portions, with said first end portions being pivotably connected to said first side of said platform about a first common axis fixed in relation to said platform, and said stabilizing means also being provided with a lower extensible linkage means having first end portions and second end portions, with said second end portions of said second linkage means being pivotably connected to said first side of said base about a second common axis fixed in relation to said base and being parallel with and in vertical alignment with said first common axis; said stabilizing means also being provided with connecting means positioned between said second end portions of said first linkage means and said first end portions of said second linkage means, with said connecting means constraining said first and said second linkage means so that said linkage means move in unison; each of said first and said second linkage means comprising a first inner rigid member pivotably secured between two second outer rigid members by a median pivot means whereby said second outer members are held in spaced apart relationship for constrained arcuate movement about a common median axis, with said first and said second rigid members having end portions; said connecting means further comprising a plurality of intermediate axes, with each of said axes passing through one of said end portions of said first inner rigid member of one of said linkage means and through one of said end portions of said second outer rigid members of the other of said linkage means in such a way as to confine these second outer rigid members to arcuate movement relative to said first inner rigid member; said first inner rigid members of said linkage means locate said median and said intermediate axes parallel with said common axes;

said platform of said lifting apparatus being provided with first and second recesses and said lifting apparatus further being provided with a backrest assembly comprising a frame, a facing supported on said frame oppositely directed lugs positioned on said frame so as to fit into said first recesses of said platform, and manually retractable bolts biased to outwardly projecting positions so as to engage in said second recesses of said platform.

2. A lifting apparatus according to claim 1, in which said connecting means comprises an intermediate pivot means positioned so as to directly pivotably connect said first and said second linkage means.

3. A lifting apparatus according to claim 1, in which said first linkage means is provided with a first main pivot means projecting outwardly from said first ends of said first linkage means, with said first pivot means being supported by sliders which are slidably receivable within a pair of guides having end portions and being positioned in parallel relation to one another on said first side of said platform and offset from first linkage means; and in which said second linkage means is provided with a second main pivot means projecting outwardly from said second ends of said second linkage means, with said second pivot means being supported by sliders which are slidably receivable within a pair of guides having end portions and being positioned in parallel relation to one another on said first side of said base and offset from said second linkage means.

4. A lifting apparatus according to claim 3, in which said first pivot means comprises a first rigid rod, and in which said second pivot means comprises a second rigid rod, with said first and said second rods extending across said platform stabilizing means and being secured in said end portions of said guides.

5. A lifting apparatus which comprises:

a base provided with a first side;

a platform provided with a first side and a second side;

thrust means positioned between said first side of said base and said first side of said platform to lift said platform relative to said base;

platform stabilizing means enclosed within said thrust means and maintaining said base and said platform n parallel relation to one another, said stabilizing means being provided with a first extensible linkage means having first end portions and second end portions, with said first end portions being pivotably connected to said first side of said platform about a first common axis fixed in relation to said platform, and said stabilizing means also being provided with a lower extensible linkage means having first end portions and second end portions, with said second end portions of said second linkage means being pivotably connected to said first side of said base about a second common axis fixed in relation to said base and being parallel with and in vertical alignment with said first common axis; said stabilizing means also being provided with connecting means positioned between said second end portions of said first linkage means and said first end portions of said second linkage means, with said connecting means constraining said first and said second linkage means so that said linkage means move in unison; each of said first and second linkage means comprising a first inner rigid member pivotably secured between two second outer rigid members by a median pivot means whereby said second outer members are held in spaced apart relationship for constrained arcuate movement about a common median axis, with said first and said second rigid members having end portions; said connecting means further comprising a plurality of intermediate axes, with each of said axes passing through one of said end portions of said first inner rigid member of one of said linkage means and through one of said end portions of said second outer rigid members of the other of said linkage means in such a way as to confine these second outer rigid members to arcuate movement relative to said first inner rigid member; said first inner rigid members of said linkage means locate said median and said intermediate axes parallel with said common axes;

said platform being provided with side edges, and an elongate headed protuberance being joined to said platform by means of a neck provided on said protuberance; and said lifting assembly further comprises a first relatively rigid part having an elongate recess shaped to receive said protuberance, a second relatively rigid part secured to said flank panel, and a thin flexible elongate intermediate part joining said first and said second rigid parts; and in which said flank panel further includes a hinge provided on said rigid parts, and said hinge being a co-extrusion of rigid and flexible plastics material.

6. A lifting apparatus according to claim 5, in which said first rigid member is provided with two integrally incorporated parallel main elongate portions having first and second ends projecting therefrom, and with a plurality of rigid transverse portions extending between and supporting said main elongate portions.

7. A lifting apparatus according to claim 5, in which said first inner and said second outer rigid members are provided with axially elongate cylindrical sockets, and in which each of said intermediate and said median pivot means comprises a rigid rod extending transversely across said platform stabilizing means and through said cylindrical sockets of said first inner and said second outer rigid members.

8. A lifting apparatus according to claim 5, in which said first main pivot means comprises a rigid rod extending across said platform stabilizing means and secured in said sliders, and in which said second main pivot means comprises a rigid rod extending across said platform stabilizing means and secured in said sliders.

9. A lifting apparatus according to claim 1, in which said thrust means includes a flexible wall provided with vertically spaced horizontal stiffeners, with said stiffeners being bonded to said wall independently of said platform stabilizing means, and with said stiffeners being of flattened cross-section.

10. A lifting apparatus according to claim 1, in which said thrust means includes a flexible wall provided with vertically spaced horizontal stiffeners, with said stiffeners being bonded to said wall independently of said platform stabilizing means, and with said stiffeners being of tapered cross-section.

11. a lifting apparatus according to claim 10, wherein said first linkage means is further provided with a coaxial first pivot means and a first common axis fixed relative to said first side of said platform, and wherein said second linkage means is further provided with a second pivot means and a second common axis fixed relative to said first side of said base; and a first two of said first end portions of said first linkage means are secured to said first side of said platform by said first pivot means constraining movement about a first common axis, and wherein a second two of said first end portions of said first linkage means are linearly movable in relation to said platform and are perpendicular to said first common fixed axis; and wherein a first two of said second end portions of said second linkage device are secured to said first side of said base by said second pivot means and constrain pivotal movement about a second common axis, with said second common axis being disposed vertically below and in parallel relation to said first common axis in such a way that a second two of said second end portions of said second linkage device are movable in unison relative to said first side of said base, with said unison movement being in directions perpendicular to said second common axis.

* * * * *